US007766771B2

(12) United States Patent
Vysosias

(10) Patent No.: US 7,766,771 B2
(45) Date of Patent: Aug. 3, 2010

(54) CIRCONIC GAME

(76) Inventor: Vero Vysosias, 12816 Pinhiero Pl., Baldwin Park, CA (US) 91706

( * ) Notice: Subject to any disclaimer, the term of this patent is extended or adjusted under 35 U.S.C. 154(b) by 0 days.

(21) Appl. No.: 12/264,238

(22) Filed: Nov. 3, 2008

(65) Prior Publication Data

US 2010/0113190 A1 May 6, 2010

(51) Int. Cl.
*A63B 67/00* (2006.01)

(52) U.S. Cl. ..... 473/472

(58) Field of Classification Search ..... 473/415, 473/466, 470–474; 119/464; 273/350; 362/444, 362/445, 446
See application file for complete search history.

(56) References Cited

U.S. PATENT DOCUMENTS 2,130,820 A * 9/1938 Trumbull ..... 473/470
3,134,594 A * 5/1964 Crowley ..... 273/350
3,602,504 A * 8/1971 Chapman et al. ..... 473/416
3,989,250 A * 11/1976 Lakeman ..... 273/350
4,453,720 A * 6/1984 King ..... 473/473
5,549,293 A * 8/1996 Seifert ..... 273/317.3
5,692,979 A * 12/1997 Jones ..... 473/470
6,390,940 B1 * 5/2002 Naulls et al. ..... 473/472
2003/0190981 A1 * 10/2003 Walker et al. ..... 473/447
2004/0204269 A1 * 10/2004 Miro et al. ..... 473/415

* cited by examiner

*Primary Examiner*—Gene Kim
*Assistant Examiner*—Mike Chambers

(57) ABSTRACT

Circonic Game, a simulated indoor or outdoor basketball game, is played on a circular court outlined by three concentric circles. The outer circle acts as the court boundary and is conjoined by four smaller circles placed tangentially in a location that conforms to the four cardinal points of the compass (i.e., north, south, west and east). Four similar smaller circles are placed in a location that conforms to four cardinal points of the compass (i.e., north, south, west and east) inside the two inner concentric circles of different radii forming a cluster of rings. A center pole in an upright position is mounted at the center of the court. Towards the top of the center pole are two primary ring baskets circumscribed by a larger circumferential ring basket supported by a transverse bar attached or welded to the rebounding center post centered in between these two primary ring baskets.

3 Claims, 5 Drawing Sheets

PERSPECTIVE VIEW

CIRCULAR COURT DIAGRAM

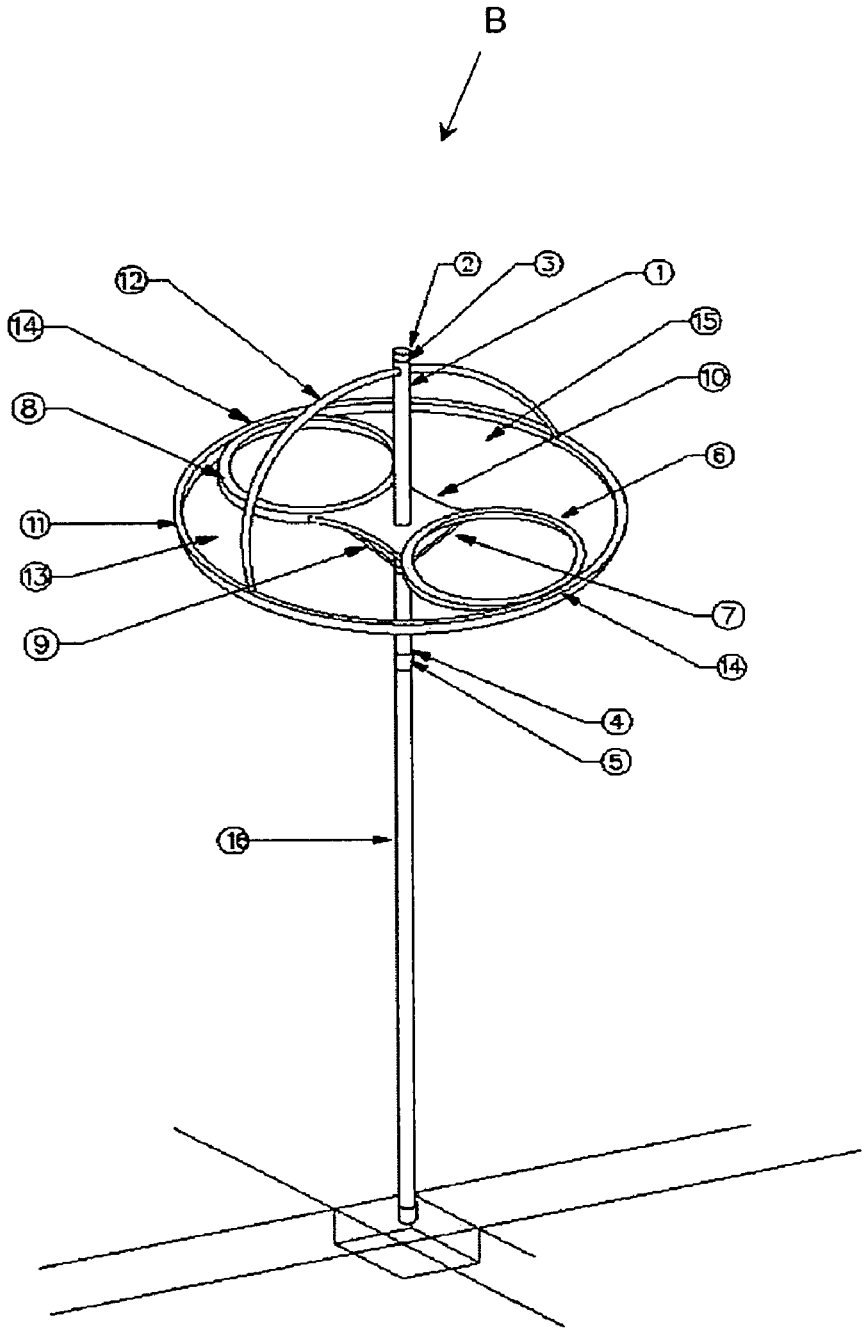
FIG. 1: PERSPECTIVE VIEW

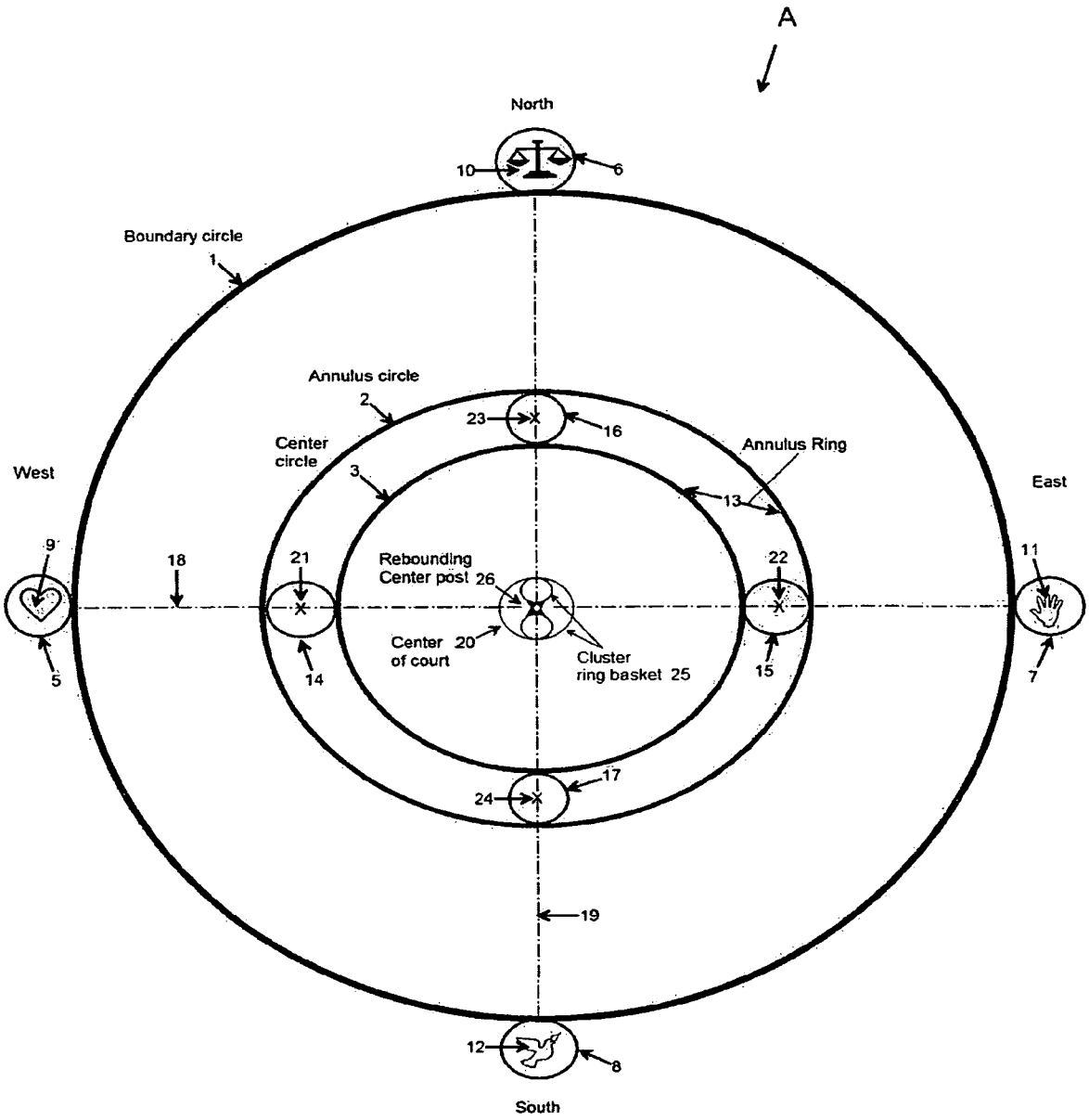
FIG. 2: CIRCULAR COURT DIAGRAM

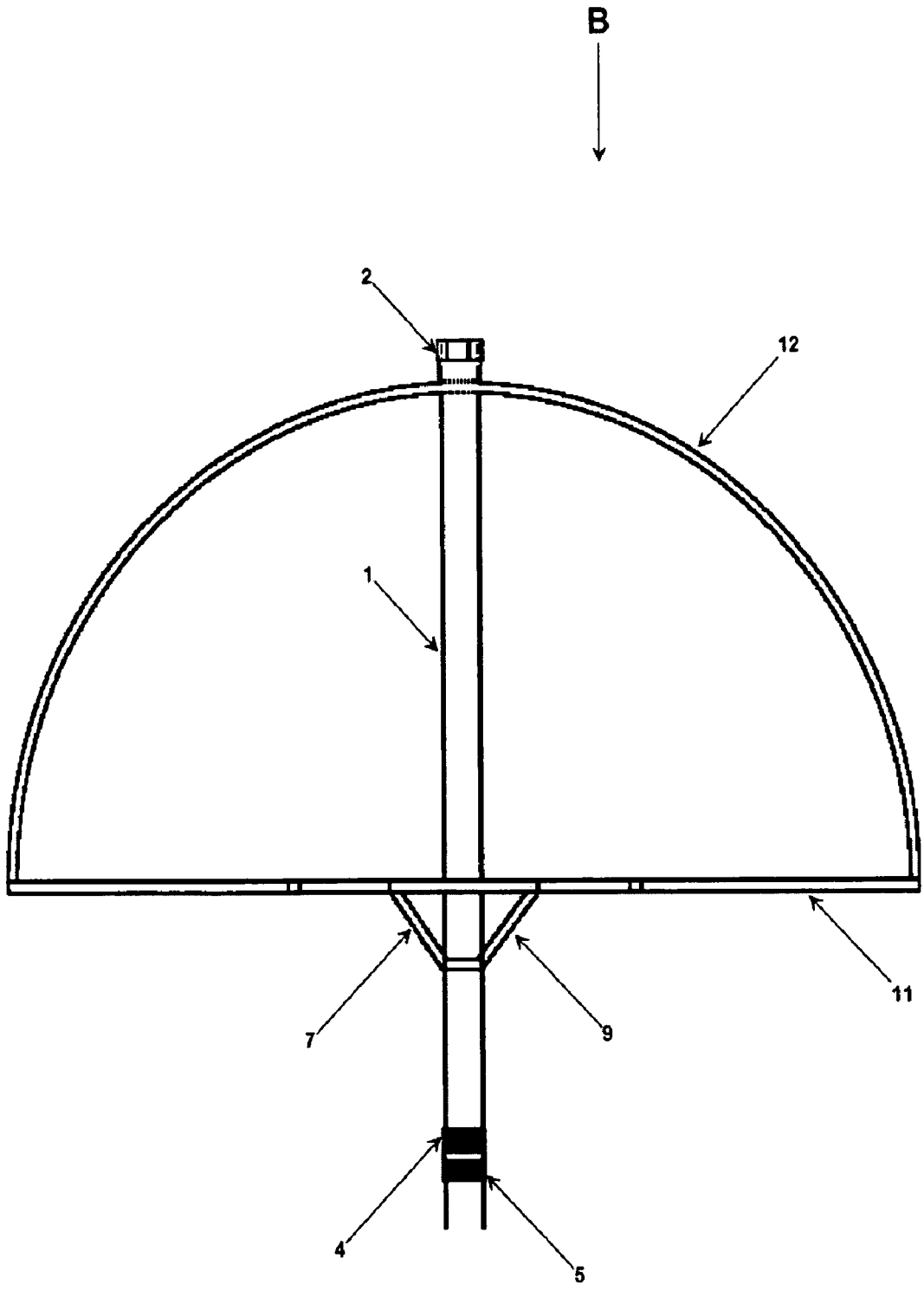
FIG. 3: FRONT VIEW

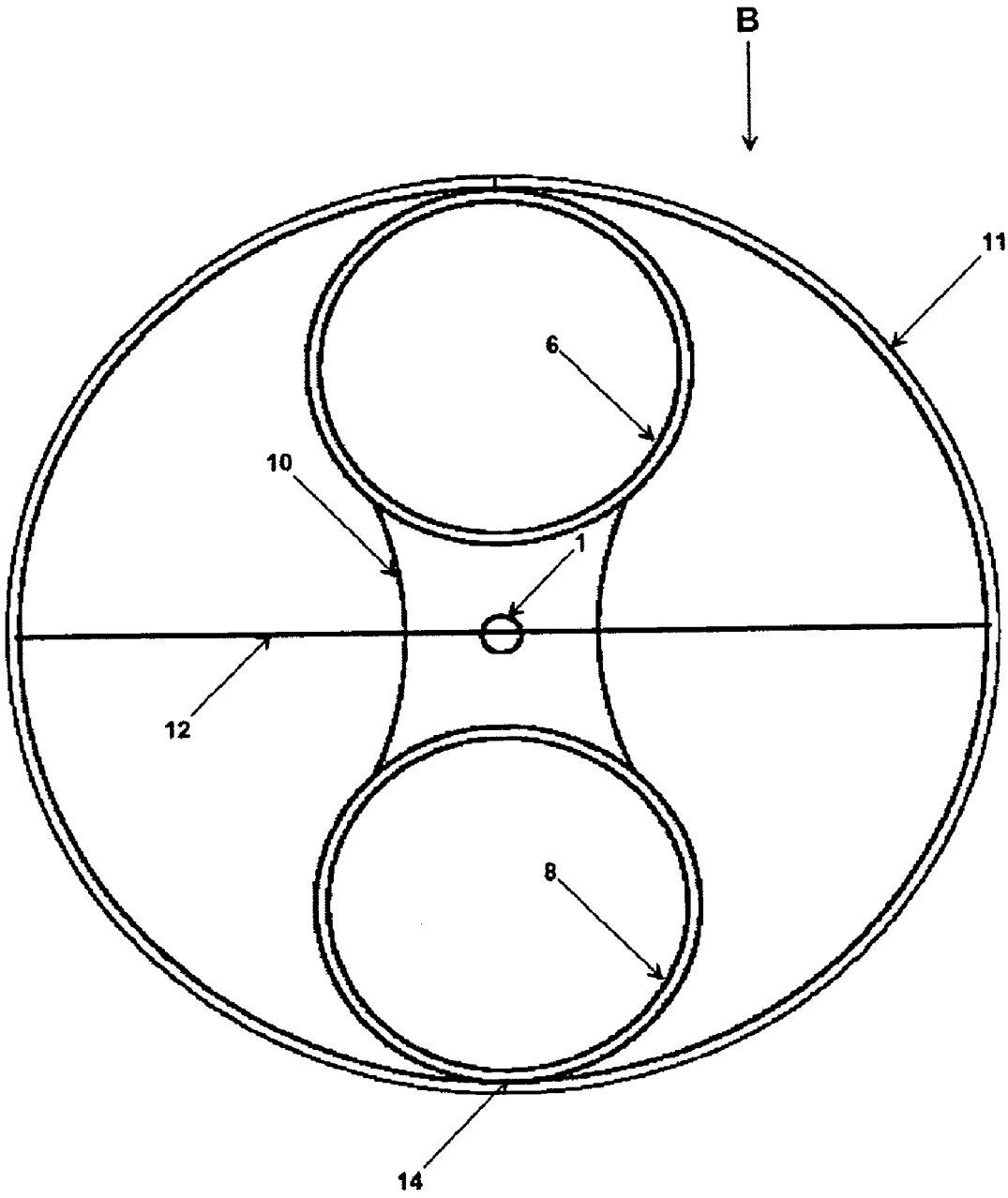
FIG. 4: TOP VIEW

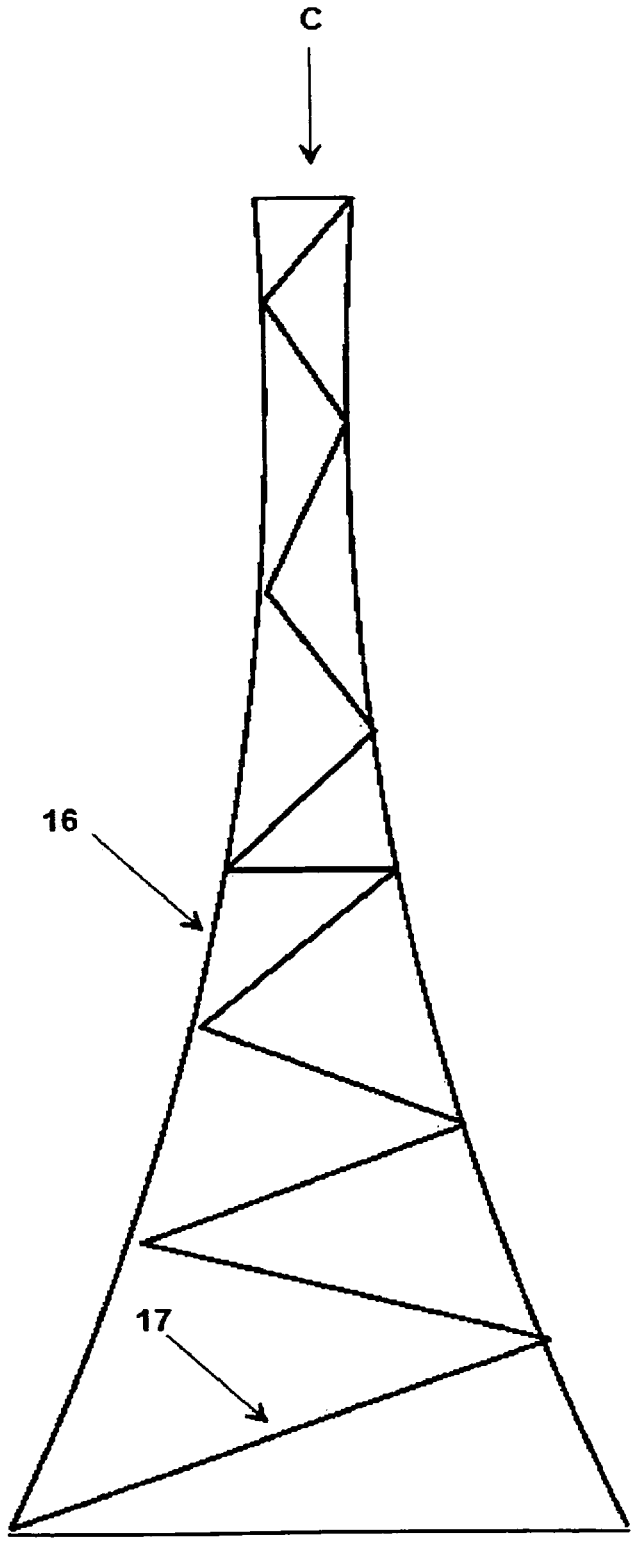
FIG. 5: FRONT VIEW OF TOWER SUPPORT

CIRCONIC GAME

REFERENCES CITED RELATED U.S. PATENT DOCUMENTS

| | | | |
|---|---|---|---|
| 6,142,890 | Oct. 21, 1998 | Craig; Gregory Alan | (473/472) |
| 5,836,837 | Nov. 17, 1998 | Craig; Gregory Alan | (473/472) |
| 3,602,505 | Aug. 31, 1971 | Friend; Leroy E. | (473/470) |
| 7,413,522 | Aug. 19, 2008 | O'Niel, et. al. | (473/481) |

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

This utility model relates to the playing of simulated indoor or outdoor basketball game of skill inside a circular court using a cluster of ring baskets.

The most popular game of basketball is currently played in a rectangular court with two rings of baskets at the two opposite ends of a rectangular court.

This utility model displays very few features of the game of basketball such as the use of a ball to score points. However, the similarity ends in the use of a unique cluster ring of baskets in a center circular court, the handling of the ball among players, the movement of players within the circular court area with its own specific and well-defined rules and regulations that involve a mixture of competitive, interactive and cooperative game of play.

This utility model can be defined under the Classification Definition, Class 473 with Subclass 465 as paraphrased below.

Class 473, Games Using Tangible Projectile

Subject matter relating to a directly interactive and competitive game or sport in which two or more opposing players or teams of players located upon or within a playing area manipulate or otherwise use a game projectile during play of the game or sport, and over which playing area at least one of the two or more opposing players or teams, in trying to achieve the game objective, moves, either while manipulating the projectile or while interacting with, reacting to, or responding to another player who is manipulating the projectile or to movement of the projectile itself whenever it is free of the players "direct control" . . .

465. Having at least two different types of game elements used in same game:

This subclass is indented under subclass 415. Playing field or court game comprising at least two diverse types of game components (e.g., a playing area combined with a goal or target, with a field or court dividing means, with a projectile, with a projector, etc. or a projector combined with a projectile, etc.) which are adapted and intended to be used in a playing field or court game or sport which is played according to a single set of rules (e.g., played according to the rules of any one of the games of basketball, soccer, hockey, baseball, tennis, etc.).

BRIEF SUMMARY OF THE INVENTION

The specific object of the utility model is to provide for playing simulated basketball using a cluster of rings having two smaller primary ring baskets specifically arranged in a back-to-back arrangement with holders, braces and transverse bar attached or welded to the rebounding center post centered in between these two primary rings. The opposite sides of these primary rings in tandem rests and is welded on the two opposite sides of the outer circumferential ring which is circumscribing these two smaller rings with the rebounding center post at the center connected by a coupling to a standing round pipe post embedded in concrete at the ground or attached to a sand or water-anchorable tower assembly in an outdoor setting.

Another object of the utility model is to provide an outer circumferential ring to form two secondary ring openings within its opposite sides while it circles around and support the two primary rings on its contact point. The outer ring is held to the rebounder center post by a transverse bar that goes through holes in the upper level boundary of the measured rebounding center post. Both ends of the transverse bar are equally spaced from the round pipe post, equally spaced circumferentially from point of contact to point of contact of the bigger ring and equally spaced vertically from the rebounding post to the outer ring.

It is also the object of the model to provide a game device which is simple, portable and universally designed. This utility model is played in a circular court with its own well-defined dimensions as described in the following appended drawings.

BRIEF DESCRIPTION OF THE SEVERAL VIEWS OF THE DRAWING

Other objects and features of the utility model will appear in the following description of the appended drawings, wherein:

FIG. 1 is a perspective view of the cluster ring basket device;

FIG. 2 is a circular court diagram of Circonic Game;

FIG. 3 is a front view of the cluster ring basket device;

FIG. 4 is a top view of the cluster ring basket device; and

FIG. 5 is a front view of a secondary tower-like support structure.

DETAILED DESCRIPTION OF THE INVENTION

Specifications.

Now referring to the drawings, particularly in FIG. 1, there is illustrated a cluster ring basket device generally designated as B.

This cluster ring basket B essentially comprises a main tubular vertical rebounding center post 1 with an opposed end having externally threaded portion 3 and 4 and a pair of couplings 2 and 4, respectively adapted to be detachably secured on said threaded portion 3 and 4. Oppositely secured and transversely of the central portion of the center post 1 is a pair of primary rings 6 and 8. These rings 6 and 8 are spacedly secured through a flat plate ring holder 10 having generally arcuated side edges. This ring holder 10 is centrally secured on said center post 1 by weld or screws. For rigidness in construction, supporting braces 7 and 9 opposedly secured the ring holder 10 with the center post 1. Circumferentially enclosing the primary rings 6 and 8 is an outer circumferential ring 11 which is welded in contact with the outermost portion of primary rings at portion 14.

Formed within this outer circumferential ring 11 and transversely of the primary rings 6 and 8 are the secondary ring baskets 13 and 15.

In the use of this game device, should a ball aim to be shoot at the primary rings 6 or 8 fails and fall to either secondary basket 13 or 15, a point score or goal could also be considered.

The opposed end of this outer circumferential ring 11 is rigidly secured and supported by an arcuated bar 12 transversely passing on the upper part of the rebounding center post 1. For permanency in structure, this ring basket B could be detachably secured on a secondary stationary support 16 which is embedded in concrete at the ground.

For portability, this ring basket B could also be detachably secured on a secondary tower-like support structure 16 as illustrated in FIG. 5, designated as C. This said secondary tower-like support structure 16 is built with tough composite material on which rigid bars 17 are attached diagonally, horizontally or vertically throughout the tower-like support structure 16.

The ring basket B could also be hanging from a ceiling or roof structure of an indoor building.

Also, referring to the drawings, particularly in FIG. 2, there is illustrated a circular court diagram generally designated as A.

This circular court area is comprised of three concentric rings known as outer boundary circle 1, annulus circle 2 and center circle 3. The boundary circle 1 is conjoined by four additional smaller circles 5, 6, 7, and 8. These four smaller circles also known as care and share circles placed tangentially at the four cardinal points of the compass (north, south, west and east) conforming to the body of the court, are marked at its center points 21, 22, 23 and 24 (labeled as X) with four widely known symbols of love, purity, honesty and unselfishness drawn in the form of a heart 9, a white dove 12, a scale 10, and a helping hand 11, respectively.

Where two circles 2 and 3 are concentric, the shape commonly referred to it visually is a ring. The annulus ring 13 is the space between the perimeter of two concentric circles of different radii. The annulus ring 13 is bounded by the center circle 3 and the annulus circle 2. Inside the annulus ring 13, four smaller circles are placed at the four cardinal points of the compass (north, south, west and east). These four smaller circles are known as the drop ball circles 14 and 15 and the free-throw circles 16 and 17.

The two drop ball circles 14 and 15 are situated inside the annulus ring 13 on the East and West area of the court and shall be formed by placing center points 21 and 22 (labeled as X) on an imaginary diameter line 18 running across the center of the court 20 from East to West direction. Both center points 21 and 22 (labeled as X) are equidistant from the center of the court 20 to the nearest point of the court boundary circle 1.

The two free-throw circles 16 and 17 are situated inside the annulus ring 13 on the North and South area of the court and shall be formed by placing the center points 23 and 24 (labeled as X) on an imaginary diameter line 19 running across the center of the court 20 from North to South direction. Both center points 23 and 24 (labeled as X) are equidistant from the center of the court 20 to the nearest point of the court boundary circle 1.

At the exact center of the court 20 is located the rebounding center post 26 on which a bunch of ring baskets 25 in tandem is installed.

The game is played in accordance with the established official rules and regulations of Circonic Game. Some of the unique aspects of the game are as follows:

1. A Team Play which consist of six (6) players each team (with four (4) personal fouls each for disqualification purposes), One (1) coach, Two (2) comforters/counselors (i.e., assistant coaches whose other function is to intercede for disqualified players).
2. Four quarter plays of twelve (12) minutes each quarter; Five (5) timeouts of 100 seconds each; One (1) extra period of 12 minutes to break Regular Score tie only.
3. The primary ring baskets 6 or 8 earns three (3) points. The secondary ring baskets 13 or 15 earns one (1) point. Points are accumulated based on the various type of scores successfully made. Whichever team earns the highest score at the end of the game wins. The various type of scores are:
   a) Regular score (Try for goal)
   b) Morality score (Beneficiary's successful shots to its own primary basket 6 or 8 during a Morality Play)
   c) Bonus score (First team to complete "giving", using agreed-upon high-low numbers)
   d) Try for Points score (1 shot in the opponent's primary ring basket 6 or 8 at end of period)
   e) Human Rights score (added to the losing team's total score until "it hurts")
4. A new "drop ball" play whereby two opposing players of almost the same height are putting the ball into play by dropping the elevated ball from the highest reachable point within the drop ball circles 14 or 15 and the drop ball players shall make three (3) full steps backward and both feet shall be clearly out of circle area 14 or 15 before a try for possession of the ball. The first drop ball player to touch the ball with one of his hands after it has rebounded from the floor shall automatically be the player to have possession of the ball.
5. A new "Morality" play is the giving of the ball from the hands of a charitable player in the care and share circles 5, 6, 7 or 8 for the happiness of an opponent player (beneficiary) to try for a morality score. Morality play symbolizes love, purity, honesty and unselfishness. Morality play is also dedicated to brotherly and benevolent love; to generosity, to fairness and uprightness of character or action; to undue harshness or roughness and to physical fitness of body and mind. Love, purity, honesty and unselfishness are universally known moralistic aims inculcated in the youth. These objectives shall be experienced and practiced fundamentally in this game.
6. A new "Miracle of Forgiveness" play. At the voluntary behest of the opposing team, in order to show their good moral character, they may allow any disqualified player to become active and eligible again and continue playing with his team again. The prompting must be directed to an official whose decision must be respected by both teams. The second time a disqualification is imposed on a forgiven player will be irrevocable.
7. A new "Human Rights" play initiated by a team ahead in the total score of the game but whose desire is "to give more and more until it hurts" to the opposing team who is behind in total score. At the option of the team who's ahead in total score, any number of try for goal is voluntarily given to the team who's behind in total score. The human right play is between the winning and the losing team with the consent of the coach or manager of the winning team and with the concurrence of the counselors or comforters. The ball is given to the losing team to make a number of shots until the giving more and more of try for goal consciously hurts. This is character building of the giver hence a human right.

I claim:

1. A game apparatus for playing a Circonic Game comprising:

1) a goal structure for the said game comprising:

a vertical support member and a goal;

wherein said goal comprises:

a main tubular vertical rebounding center post with an opposed externally threaded end portion, a plate ring holder centrally secured transversely of said center post, an opposed horizontally disposed pair of primary rings secured on said plate ring holder, supporting braces opposedly secured the said plate ring holder with the said center post, an outer circumferential ring enclosing said pair of primary rings with the outer end of said rings resting on the outer ring, a pair of circumferential arcs vertically disposed on each opposed end to said outer circumferential ring and attached on the other end to the upper part of the said vertical support member, wherein said apparatus is secured as a single structure in the center of a playing area;

2) a planar playing area having indicia comprising five individual and interconnected court area circles wherein the first individual and interconnected court area circle consists of a large circle of approximately seventy (70) feet in diameter which forms the main court area boundary circle (FIG. 2, item 1) wherein the four remaining smaller conjoined circles (FIG. 2, items 5,6,7,8) that are approximately six feet in diameter and bear at its center point inscriptions representing four universally known symbols of love, purity, honesty and unselfishness drawn in the form of a heart, a dove, a scale, and a hand, respectively and placed on said boundary circle such that the smaller conjoined circles are located at 0,90,180 and 270 degrees respectively on the perimeter of said boundary circle.

2. The playing area of claim 1 further comprising a plurality of two additional intermediary concentric circles (FIG. 2, item 2, 3) contained within said boundary circle.

3. The playing area of claim 2 further comprising a plurality of four smaller interconnected circles wherein each of the smaller circles are contained between the two intermediary concentric court circles and lie along an axis between the center of the boundary circle and the center of the adjacent conjoined circle.

* * * * *